US008672019B1

(12) United States Patent
Kager

(10) Patent No.: US 8,672,019 B1
(45) Date of Patent: Mar. 18, 2014

(54) CLEANING UNIT FOR A CONTINUOUS METAL STRIP AS WELL AS A STRIP CASTING INSTALLATION WITH SUCH A CLEANING UNIT

(71) Applicant: Berndorf Band GmbH, Berndorf (AT)

(72) Inventor: Franz Kager, Schwechat (AT)

(73) Assignee: Berndorf Band GmbH, Berndorf (AT)

( * ) Notice: Subject to any disclaimer, the term of this patent is extended or adjusted under 35 U.S.C. 154(b) by 0 days.

(21) Appl. No.: 13/727,722

(22) Filed: Dec. 27, 2012

(51) Int. Cl.
*B22D 11/06* (2006.01)
*B22D 43/00* (2006.01)

(52) U.S. Cl.
USPC ..... 164/429; 164/432; 164/158

(58) Field of Classification Search
USPC ..... 164/429, 432, 479, 481, 158; 134/9, 15
See application file for complete search history.

(56) References Cited

U.S. PATENT DOCUMENTS 3,795,269 A * 3/1974 Leconte et al. ..... 164/472
3,983,889 A * 10/1976 Thym et al. ..... 134/9
4,979,557 A * 12/1990 Honeycutt, III ..... 164/463
7,296,614 B2 * 11/2007 Schlichting et al. ..... 164/480
2009/0324277 A1 * 12/2009 Ito ..... 399/101

FOREIGN PATENT DOCUMENTS

| | | | |
|---|---|---|---|
| DE | 2 249 740 | A1 | 4/1974 |
| DE | 37 34 236 | A1 | 4/1989 |
| DE | 267 673 | A1 | 5/1989 |
| DE | 199 29 843 | A1 | 1/2001 |
| GB | 1 443 965 | A | 7/1976 |

* cited by examiner

*Primary Examiner* — Kevin P Kerns

(74) *Attorney, Agent, or Firm* — Collard & Roe, P.C.

(57) ABSTRACT

An arrangement includes a continuous band made of metal, at least two guiding rollers, around which the continuous band is guided, and a first drive, which is set up to move the metal strip. Furthermore, the arrangement includes a textile band, a pressing device, which is set up to press the textile band against the metal strip, and a second drive which is set up to move the textile band past the pressing device. The textile band is set up to clean the continuous band made of metal. In addition, a strip casting installation is also provided which includes an arrangement of this type.

11 Claims, 4 Drawing Sheets

CLEANING UNIT FOR A CONTINUOUS METAL STRIP AS WELL AS A STRIP CASTING INSTALLATION WITH SUCH A CLEANING UNIT

BACKGROUND OF THE INVENTION

1. Field of the Invention

The invention relates to an arrangement, comprising a continuous metal strip, at least two guiding rollers, around which the continuous strip is guided, and a first drive, which is set up to move the metal strip.

2. The Prior Art

An arrangement of this kind is known in principle from the prior art and can be used for example for a strip casting installation. Strip casting installations are generally used for producing panel-like or film-like materials. For example, they are used for the production of photographic film, LCD screens and also artificial stone ("engineered stone"). In this case a liquid or paste-like material is applied onto a driven/moved band and the at least partly hardened material is lifted off. For example, a liquid film can be cast onto the continuous band, run through various different processes such as heating, stretching, drying etc. and then be scraped off the band. In these kinds of strip casting installations it is possible for the continuous bands to get dirty from the processing and for them to require cleaning. This results in downtime which is associated with financial loss.

SUMMARY OF THE INVENTION

Therefore, one objective of the present invention is to provide an improved arrangement of the said kind. In particular, it should enable low-maintenance cleaning of the band which is as effective as possible.

The objective of the invention is achieved by means of an arrangement of the aforementioned kind, additionally comprising:

- a textile band,
- a pressing device set up to push the textile band against the metal strip, and
- a second drive set up to move the textile band past the pressing device.

The objective is also achieved by means of a strip casting installation, comprising an arrangement of the aforementioned kind and a device for applying a material onto the metal strip.

By means of the proposed measures the metal strip can be freed of dirt in an effective manner, as on the movement of the textile band past the pressing device a clean and/or unused area of the textile band can always be brought into contact with the metal strip and the latter can be cleaned thereby. The textile band can be moved past the pressing device step-by-step or continuously. The pressing device can be configured for example as a pressing plate or also as a pressing roller. Preferably, the textile band is essentially as wide as the metal strip. It is also possible for the metal strip only to be cleaned is some areas by a textile band. In particular, also a plurality of narrow bands can be arranged next to one another and in this way clean the entire or substantially the entire width of the metal strip.

Advantageously, cleaning and maintenance work are considerably simplified by the proposed measures. As a rule, these activities can be performed during running operation or routine operation, that is during the production of the panel-like or film-like materials. In this way the economic efficiency of a strip casting installation and the planning of the production process are substantially improved. By way of the simplified method of cleaning the continuous band, the latter is kept in optimum condition for a longer period and in this way the quality of the product is improved.

Further advantageous embodiments and developments of the invention are described in the subordinate claims and the description in combination with the Figures.

It is particularly advantageous if the arrangement comprises a reel coupled to the second drive, to which reel one end of the textile strip is secured. In this way used band can be wound up, for example for subsequent disposal or recycling. The unused textile band can be wound in a similar way from a second reel.

However, it is also an advantage if the textile band is in the form of a continuous band, which is guided around at least two guiding rollers, at least one of which is coupled to a second drive. In particular, the used area of the textile band can be guided past a processing station at which the textile band is prepared for further cleaning of the metal strip. For example, such in a processing station dirt can be washed out of the textile band. Advantageously, a textile band of this kind can be guided past the metal strip several times until it has to be disposed of or sent to a special reprocessing unit.

In a particularly advantageous embodiment the proposed arrangement comprises a wetting device, which is prepared to wet the textile band with a liquid, in particular a cleaning fluid and/or a solvent. By means of the wetting device the textile band can thus be moistened and its cleaning effect can be increased in this way. In particular, this is the case when the band is soaked in a cleaning fluid and/or a solvent, for example acetone.

Preferably, the speed of the metal strip is greater than the textile band. In this way the excessive usage of textile bands can be avoided.

It is advantageous if the textile band is made from fleece, fabric, knitted fabric, braided fabric, meshed fabric, felt or a combination of said textiles. By selecting a suitable material the textile band can be adapted in an optimum manner to the intended purpose, particularly if different materials are combined. For example, a felt-like material for cleaning the band can be laminated onto a linen-like material so that the textile band has greater stability.

Preferably, the proposed arrangement comprises a scraper which is arranged upstream of the textile band in a main direction of movement of the metal strip and acts on the metal strip. By means of the scraper heavy dirt can be removed from the metal strip. It is also possible that the product produced on the metal strip, for example film or artificial stone, is lifted by such a scraper. The "main direction of movement" is defined within the scope of the invention as the direction of movement of the continuous band, in which the panel-like or film-like materials are produced. Accordingly, this is the direction of movement of the continuous band, in which the material applied by the application device onto the continuous band is transported essentially over the upper strand to the lifting device. The "upper strand" is the upper, carrying part of a driven continuous band, whereas the "lower strand" is the lower, non-carrying part of the continuous band. A temporary movement of the metal strip opposite this main direction of movement is not excluded however within the scope of the invention.

It is advantageous if the proposed arrangement comprises a cleaning brush arranged between the scraper and the textile band and acting on the metal strip. In this way heavy dirt can be removed from the metal strip. The cleaning is performed in this case step-by-step according to the amount of dirt. Particularly heavy dirt is removed by the scraper, medium level dirt is removed by the cleaning brush and the remaining dirt is removed by the textile band. In order to improve the effect of the cleaning in particular high-pressure cleaning jets can be arranged upstream of or downstream of the cleaning brush.

It is advantageous if the arrangement comprises a suction device which is arranged downstream of the textile band in a main direction of movement of the metal strip and acts on the metal strip. In this way fluid and fluff which may remain on the band after the textile band stage are suctioned off, thus improving the cleanness of the metal strip further.

It is particularly advantageous if the arrangement comprises a multi-lip seal arranged transversely to the direction of movement of the metal strip, which is arranged downstream of a device for applying a liquid to the metal strip in the main direction of movement of the metal strip, wherein cavities between the lips of the multi-lip seal are connected to a run-off. The seal thus comprises a plurality of lips with cavities arranged in between. To prevent liquid from collecting permanently in the cavities the latter are each connected to a run-off. In this way the metal strip when passing the lips is visibly drier. In an advantageous manner the multi-lip seal is configured in one piece. It is of course also possible for the multi-lip seal to consist of multiple parts. For example, the lips can be inserted into a main body.

Lastly, it is particular advantageous if the arrangement comprises a spraying device aligned to the metal strip and guide plates arranged in the edge area of the metal strip, which are aligned obliquely to the center of the metal strip. In this way it is possible to prevent liquid which may be applied at very high pressure from being pushed between a seal on the edge of the metal strip. By means of the guide plates the jets of liquid are guided away from the edge area or are deflected away from the latter.

BRIEF DESCRIPTION OF THE DRAWINGS

For a better understanding of the invention the latter is explained in more detail with reference to the following Figures.

DETAILED DESCRIPTION OF THE PREFERRED EMBODIMENTS

Figure 1:
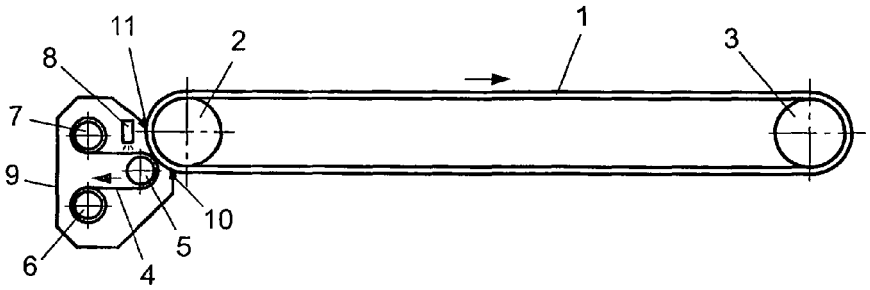
FIG. 1 shows a first schematic view of a variant of a band cleaning unit with a cleaning band and two reels in side view.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

FIG. 1 shows a first schematic view of the arrangement comprising a continuous band 1 made of metal and two guiding rollers 2, 3, around which the continuous band 1 is guided. The arrangement also comprises a first drive, which is set up to move the metal strip 1. In this example it is assumed that the drive (e.g. an electric motor) is coupled to the guiding roller 2 and rotates the latter. The shown arrangement also comprises a textile band 4, a pressing device 5, which is set up to push the textile band 4 against the metal strip 1, and a second drive which is set up to move the textile band 4 past the pressing device 5. The pressing device is configured here as a rotatably mounted pressing roller 5. It is also possible however to provide a fixed pressing plate at this point. The second drive (e.g. configured as an electric motor) is coupled to a reel 6, to which one end of the textile band 4 is secured and which can be set into rotation by the second drive. The other end of the textile band 4 is secured to a second reel 7, which is preferably braked in order to tension the textile band 4. Of course, the second reel 7 can also run idle.

During operation the textile band 4 is wound off the second reel 7 and wound onto the first reel 6 so that the metal strip 1 can always be brought into contact with an unused part of the textile band 4. The textile band 4 can be moved step-by-step or continuously. Preferably, the speed of the metal strip 1 is greater than that of the textile band 4 and preferably the textile band 4 is moved as shown in FIG. 1 opposite the direction of movement of the metal strip 1. In this way it is possible to prevent the textile band 4 being wound off the reel 7 by the metal strip 1 in an uncontrolled manner. The reel 7 can also run idle in this case.

In general the textile band 4 can be made from fleece, fabric, knitted fabric, braiding, mesh fabric, felt or a combination of said textiles. For example, a soft, non-fluffing microfiber fabric can be used which does not scratch the metal surface and does not cover it in fluff in an undesirable manner. For example, it is also possible for a cleaning fleece to be laminated onto a fabric, the cleaning fleece being provided for cleaning the metal strip 1 and the fabric giving the textile band 4 more stability.

In a preferred embodiment the textile band 4 as shown in FIG. 1 can be wetted with fluid by a wetting device 8, in particular with a cleaning fluid and/or solvent such as acetone. For example, the fluid can be sprayed onto the textile band 4 or it simply drips down onto the textile band 4. It is also possible that the liquid is applied by a separate roller. To ensure that the fluid or vapor from the latter (e.g. solvent vapor) does not spread in an uncontrolled manner the textile band 4, the components 5, 6, 7 necessary for guiding it and the wetting device 8 are accommodated in a housing 9 which is sealed by means of seals 10 and 11 from the metal strip 1.

Figure 2:
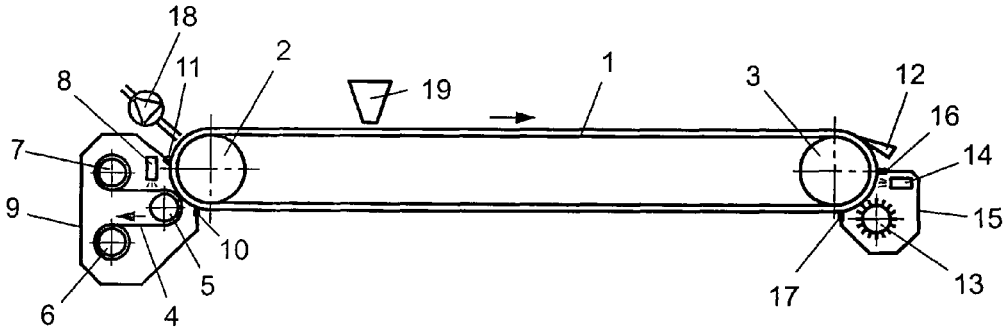
FIG. 2 as in FIG. 1, but with an additional scraper, an additional cleaning brush and an additional suction device.

FIG. 2 shows an embodiment which is based on the arrangement shown in FIG. 1. In addition, the latter comprises a scraper 12 arranged upstream of the textile band 4 in a main direction of movement (see arrow) of the metal strip 1 and acting on the metal strip, which scraper removes heavy dirt from the metal strip 1. Between the scraper 12 and the textile band 4 a cleaning brush 13 acting on the metal strip 1 is provided, here a rotating brush, which also removes heavier dirt from the metal strip 12. To support the cleaning process a spraying jet 14 is arranged upstream of the cleaning brush 13. Of course, also a plurality of spraying jets 14 can be provided.

For example, water, in particular warm water can be sprayed on. In order to prevent the uncontrolled spreading of dirt and fluid the cleaning brush 13 and the spraying jet 14 are arranged in a housing 15, which is sealed by seals 16 and 17 from the metal strip 1.

Lastly, a suction device 18 acting on the metal strip 1 is arranged downstream of the textile band 4 in a main direction of movement of the metal strip 1. The suction device 18 can be in the form of a fan. In this way liquid can be suctioned off which remains on the metal strip 1 in spite of the seal 11.

Overall a cleaning process is provided in which heavy dirt is scraped off the metal strip 1, the metal strip 1 is then cleaned further by high pressure spray jets 14 and a cleaning brush 13, dirty water is wiped off the metal strip 1 by way of the seal 17, the metal strip 1 is finally cleaned by means of the textile (and in particular fluid-soaked) band 4 and remaining fluid on the metal strip 1 is scraped off by the seal 11, respectively suctioned off by means of the suction device 18. On the left side of the upper strand thus a practically completely cleaned metal strip 1 is provided which can be used for a production process, for example for the production of films or artificial stone.

In FIG. 2 on the upper strand of the metal strip 1 a device 19 for applying a material onto the metal strip 1 is arranged, which is here in the form of a simple funnel. FIG. 2 thus discloses a schematically represented strip casting installation. Of course, this embodiment is only provided by way of example and other configurations of the device 19 are also possible.

Figure 3:
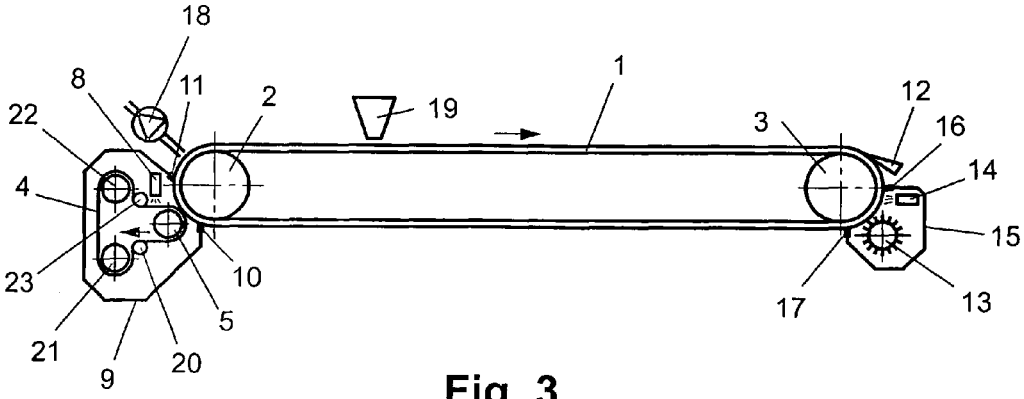
FIG. 3 as FIG. 2, but with a continuous cleaning band.

The arrangement shown in FIG. 3 is similar to the arrangement shown in FIG. 2. In contrast the textile band 4 is configured as a continuous band, which is guided around the guiding rollers 20 . . . 23, at least one of which is coupled to the second drive, for example the roller 21.

Figure 4:
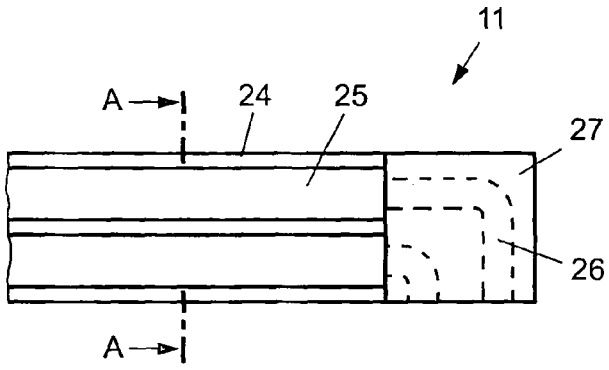
FIG. 4 shows an example of a multi-lip seal from below.
Figure 5:
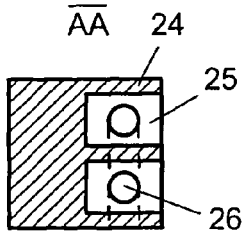
FIG. 5 shows the multi-lip seal from FIG. 4 in cross section.

FIGS. 4 and 5 show how the seals 10, 11, 16 and 17 could be configured. By way of example the seal 11 is shown, in FIG. 4 in a view from below and in FIG. 5 in section AA. Cavities 25 between the lips 24 of the multi-lip seal 11 are connected in this example to a run-off 26, which is arranged in an edge piece 27 of the multi-lip seal 11. By way of these measures a particularly effective drying of the metal strip 1 can be achieved, as lips 24 arranged downstream in the direction of movement of the metal strip 1 cannot store any fluid over a long period. The metal strip 1 thus becomes successively drier when passing the individual lips 24. The multi-lip seal 11 can be configured in one piece, or can also consist of a plurality of parts. For example, the edge piece 27 can be provided as a separate part. It would also be possible for individual sealing lips 24 to be inserted into a main body.

Figure 6:
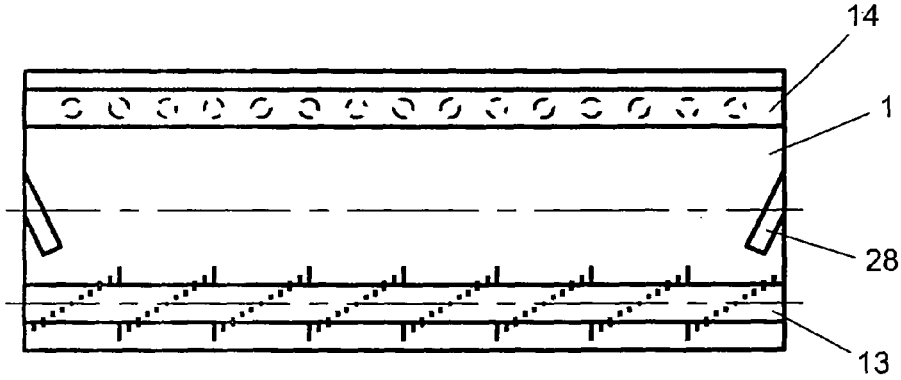
FIG. 6 shows a variant of a spraying device with guide plates arranged obliquely to the direction of movement of the metal strip.

FIG. 6 shows an arrangement by way of example and in schematic view, which comprises the spraying device 14 aligned to the metal strip 1 and guide plate 28 or guiding devices arranged in the edge area of the metal strip 1 which are aligned obliquely to the middle of the metal strip 1. With regard to FIG. 2 or 3, FIG. 6 shows a side view from the left. By means of the proposed measures liquid that may be applied under very high pressure in some circumstances is prevented from being pushed through a seal on the edge of the metal strip 1. By means of the guide plates 28 the liquid jets are largely kept away from the edge area or diverted away from the latter.

Figure 7:
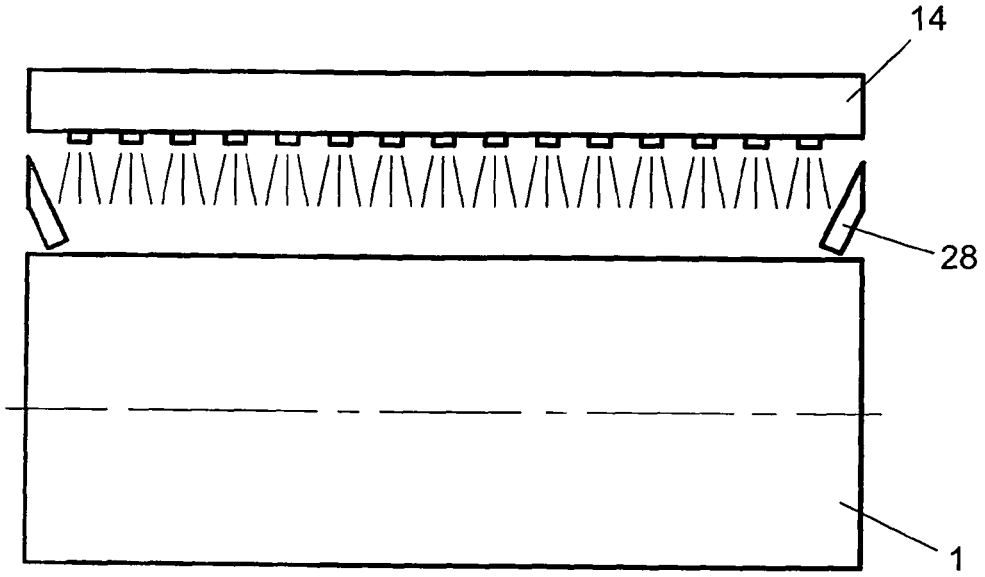
FIG. 7 shows a variant of a spraying device with guide plates arranged obliquely to the surface of the metal strip.

In FIG. 6 the guide plates 28 are aligned obliquely relative to the direction of movement of the metal strip 1. It is also possible however for the latter to be aligned obliquely to the surface of the metal strip 1. FIG. 7 shows in addition by way of example a side view in which the spraying device 14 sprays the metal strip 1 from above. The guide plates 28 keep the edge of the metal strip 1, even with such an arrangement, largely free of liquid jets or divert the latter away from the edge.

Figure 8:
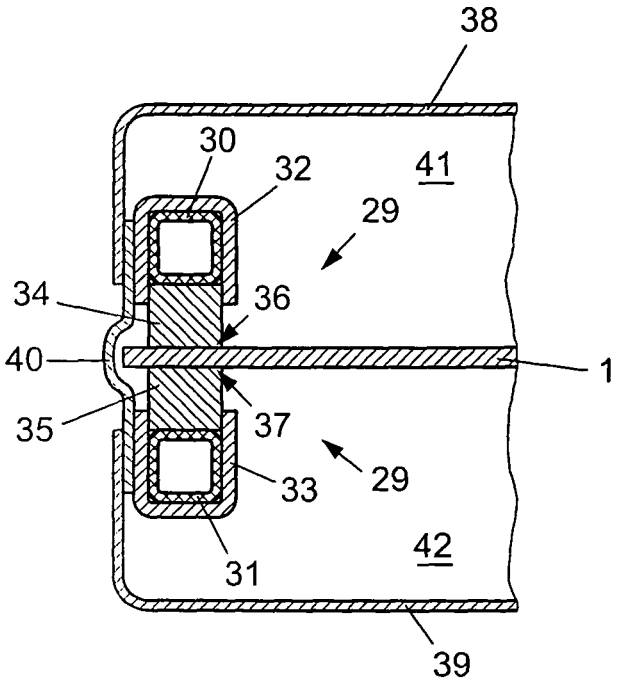
FIG. 8 shows a schematically represented example of a side seal of the metal strip in cross section and FIG. 9 as in FIG. 8, but only one of the sealing devices is provided with an inflatable body.

FIG. 8 shows an exemplary embodiment of a side seal of the metal strip 1 in its longitudinal direction or direction of movement in cross section. The sealing devices 29 arranged in this example at the top and bottom each comprise two longitudinal inflatable flexible body 30, 31, holders 32, 33, in which the said inflatable bodies 30, 31 are embedded and elongated bodies 34, 35 made of TEFLON (polytetrafluoroethylene or PTFE), which are arranged on sides of the inflatable flexible bodies 30, 31 facing away from the holders 32, 33. The TEFLON (polytetrafluoroethylene or PTFE) bodies 34, 35 also have sealing surfaces 36, 37 on a side facing away from the inflatable body 30, 31 or on a side facing the metal strip 1.

In the present example the TEFLON (polytetrafluoroethylene or PTFE) bodies 34, 35 are guided displaceably in the holders 32, 33 for the inflatable bodies 30, 31. In principle, it is therefore possible that the TEFLON (polytetrafluoroethylene or PTFE) bodies 34, 35 simply lie on the inflatable bodies 30, 31. In this case it is not absolutely necessary to secure the TEFLON (polytetrafluoroethylene or PTFE) bodies 34, 35 onto the inflatable bodies 30, 31. Of course, it is also possible to secure the TEFLON (polytetrafluoroethylene or PTFE) bodies 34, 35 on the inflatable body 30, 31. If necessary the guiding of the TEFLON (polytetrafluoroethylene or PTFE) bodies 34, 35 can also be omitted.

By means of the possible movement of the TEFLON (polytetrafluoroethylene or PTFE) bodies 34, 35 in the holders 32, 33 any unevenness and wear of the TEFLON (polytetrafluoroethylene or PTFE) bodies 34, 35 are compensated effectively. With increasing abrasion the TEFLON (polytetrafluoroethylene or PTFE) bodies 34, 35 are pushed further out of the holders 32, 33.

In the present example the holders 32, 33 are formed by a U-profile. The holders 32, 33 can thus be produced easily, for example from a metal profile or a folded edge sheet.

Furthermore, the TEFLON (polytetrafluoroethylene or PTFE) bodies 34, 35 in the present example have a rectangular cross section. In this way the TEFLON (polytetrafluoroethylene or PTFE) bodies 34, 35 can be produced easily and also have even sealing surfaces 36, 37.

In the arrangement shown in FIG. 1 the two sealing devices 29 are arranged opposite one another on a top side and a bottom side of the metal strip 1. In this way it is possible to prevent the metal strip 1 under pressure from the inflatable bodies 30, 31 from bending away from the latter and making sealing more difficult (cf. also FIG. 9). This is supported in that both sealing devices 29 arranged opposite one another have inflatable bodies 30, 31.

Figure 9:
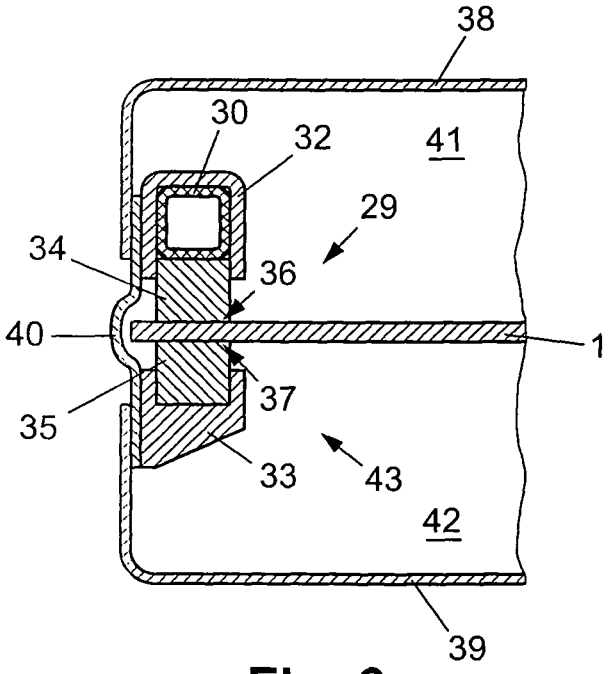

In the arrangement shown in FIG. 9 the opposite sealing devices 29 are tightly connected to one another by means of the bridge 40. In this way a cavity 41 above the metal strip 1, which is formed by the upper cover 38, and a cavity 42 below the metal strip 1, which is formed by the lower cover 39, are joined tightly together. Of course, it would also be possible to leave out the bridge 40 and consequently provide only an upper cavity 41, only a lower cavity 42 or separate cavities 41 and 42.

FIG. 9 shows a second schematically represented example of an arrangement with a sealing device 29 and a sealing device 43 as well as a moved metal strip 1 in cross section, which is very similar to the arrangement shown in FIG. 8. In contrast to this however only the upper sealing device 29 is equipped with an inflatable body 30, the lower sealing device 43 however has no inflatable body. This gives the arrangement a comparatively simple structure.

By way of the proposed measures an effective sealing of the metal strip is achieved. On the one hand the TEFLON (polytetrafluoroethylene or PTFE) body 34, 35 can be pushed by means of the inflatable body 30, 31 against the metal strip 1, whereby a seal is formed between the TEFLON (polytetrafluoroethylene or PTFE) body 34, 35 and metal strip 1, on the other hand the friction is low owing to the selection of material despite the seal, so that no excessive forces are applied onto the TEFLON (polytetrafluoroethylene or PTFE) body 34, 35 or the metal strip 1. As a result also the drive power for the metal strip 1 can be kept small. By varying the pressure in the inflatable body 30, 31 in addition in a simple manner a desired pressing force can be set. The sealing by means of the sealing device can be fluid-tight for example, but it can also be gas-tight.

Preferably, the inflatable bodies 30, 31 are connected to a compressed air supply system, which is set up to put the inflatable bodies 30, 31 under constant pressure during operation. In this way the TEFLON (polytetrafluoroethylene or PTFE) bodies 34, 35 are pushed at constant pressure onto the metal strip 1, whereby reproducible results are achieved with respect to the tightness and also with respect to the pulling force acting on the metal strip 1 and required for movement. This also applies in case of wear to the TEFLON (Polytetrafluoroethylene or PTFE) bodies 34, 35 as the pressure in the inflatable bodies 30, 31 is constant, the volume however can be variable. With increasing wear of the TEFLON (polytetrafluoroethylene or PTFE) bodies 34, 35 the volume in the inflatable bodies 30, 31 increases so that the TEFLON (polytetrafluoroethylene or PTFE) body 34, 35 with the sealing surfaces 36, 37 always lies on the metal strip 1.

It is also advantageous if the TEFLON (polytetrafluoroethylene or PTFE) body 34, 35 is made from a plurality of individual parts, which are joined together in a rod-like manner by lapping, in particular hook lapping, a tongueand-groove joint or a dovetail joint. In this way a plurality of individual rods can be joined together easily to form a longer rod. In particular, form-fit connections are advantageous, for example the hook lapping or dovetail joint, as it is difficult to adhere TEFLON (polytetrafluoroethylene or PTFE).

The exemplary embodiments show possible embodiment variants of an arrangement with a metal strip 1 and a cleaning device comprising a textile band 4 or a strip casting installation, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

For example, the arrangement shown in FIG. 7 can be used in combination with one of the arrangements shown in FIGS. 1 to 6. The sealing device shown in FIGS. 8 and 9 can be used for the arrangements shown in FIGS. 1 to 7. In particular, the suction device 18 acting on the metal strip 1, the multi-lip seal 10, 11, 15, 16 and the guide plates 28 also form the basis of an independent invention separately from the features described in other embodiments according to the invention.

In particular, it should also be noted that the shown devices in reality can also comprise more or fewer components than shown and are represented in a much simplified form in the Figures.

Finally, as a point of formality, it should be noted that for a better understanding of the structure the devices and their components have not been represented true to scale in part and/or have been enlarged and/or reduced in size.

The problem addressed by the independent solutions according to the invention can be taken from the description.

LIST OF REFERENCE NUMERALS

1 continuous band
2 guiding roller
3 guiding roller
4 textile band
5 pressing device (pressing roller)
6 reel (for winding)
7 reel (for unwinding)
8 wetting device
9 housing
10 multi-lip seal
11 multi-lip seal
12 scraper
13 cleaning brush
14 spraying device
15 housing
16 multi-lip seal
17 multi-lip seal
18 suction device
19 device for applying material (funnel)
20 guiding roller
21 guiding roller
22 guiding roller
23 guiding roller
24 sealing lip
25 cavity
26 run-off
27 edge piece
28 guide plate
29 sealing system
30 inflatable flexible body
31 inflatable flexible body
32 holder
33 holder
34 TEFLON (polytetrafluoroethylene or PTFE) body
35 TEFLON (polytetrafluoroethylene or PTFE) body
36 sealing surface
37 sealing surface
38 upper cover
39 lower cover
40 bridge
41 upper cavity
42 lower cavity
43 sealing system

The invention claimed is:

1. An arrangement, comprising:

a continuous band made of metal, at least two guiding rollers, around which the continuous band is guided, and a first drive which is set up to move the metal strip, wherein there is a textile band, a pressing device set up to push the textile band against the metal strip, a second drive set up to move the textile band past the pressing device, and a multi-lip seal which is arranged transversely to the direction of movement of the metal strip, which multi-lip seal is arranged downstream of a device for applying a liquid onto the metal strip in the main direction of movement of the metal strip, wherein cavities between the lips of the multi-lip seal are connected to a run-off.

2. The arrangement as claimed in claim 1, further comprising a reel coupled to the second drive, to which reel one end of the textile band is secured.

3. The arrangement as claimed in claim 1, wherein the textile band is configured as a continuous band which is guided around at least two guiding rollers, at least one of which is coupled to the second drive.

4. The arrangement as claimed in claim 1, wherein a wetting device is provided which is prepared to wet the textile band with a liquid.

5. The arrangement as claimed in claim 1, wherein the speed of movement of the metal strip is greater than that of the textile band.

6. The arrangement as claimed in claim 1, wherein the textile band is made from fleece, fabric, knitted fabric, braiding, meshed fabric, felt or a combination of said textiles.

7. The arrangement as claimed in claim 1, further comprising a scraper which is arranged upstream of the textile band in a main direction of movement of the metal strip and acts on the metal strip.

8. The arrangement as claimed in claim 7, wherein a cleaning brush is arranged between the scraper and the textile band and acts on the metal strip.

9. The arrangement as claimed in claim 1, wherein a suction device is arranged downstream of the textile band in a main direction of movement of the metal strip and acts on the metal strip.

10. The arrangement as claimed in claim 1, wherein a spraying device is aligned to the metal strip and guide plates are arranged in the edge area of the metal strip, which guide plates are aligned obliquely to the center of the metal strip.

11. A strip casting installation comprising an arrangement as claimed in claim 1 as well as a device for applying a material onto the metal strip.

* * * * *